US005692601A

United States Patent [19]

Moss

[11] Patent Number: 5,692,601

[45] Date of Patent: Dec. 2, 1997

[54] HIDEAWAY JEWELRY TREE

[76] Inventor: Sandra N. Moss, 8175 Eton Ct., Jonesboro, Ga. 30236

[21] Appl. No.: 739,444

[22] Filed: Oct. 29, 1996

[51] Int. Cl.[6] ..... B65D 85/02

[52] U.S. Cl. ..... 206/6.1; D9/330; 206/457; 206/807

[58] Field of Search ..... D9/330; 206/6.1, 206/457, 807; 312/128

[56] References Cited

U.S. PATENT DOCUMENTS

| | | | |
|---|---|---|---|
| 3,378,136 | 4/1968 | Lubin | 206/6.1 |
| 3,650,382 | 3/1972 | Braun et al. | 206/6.1 |
| 4,552,264 | 11/1985 | Quarrell et al. | 206/6.1 |
| 4,735,246 | 4/1988 | Niehaus | 206/6.1 |
| 5,168,985 | 12/1992 | Shih | 206/6.1 |
| 5,427,230 | 6/1995 | Mattox | 206/6.1 |
| 5,511,873 | 4/1996 | Mech | 206/6.1 |

*Primary Examiner*—Jimmy G. Foster
*Attorney, Agent, or Firm*—American Innovations Inc.; Dorothy S. Moore, Esq.

[57] ABSTRACT

A storage container for elongated pieces of jewelry, such as necklaces and bracelets, having a base member, a cover attached to the upper surface of the base member, and a plurality of jewelry support rods also attached to the upper surface of the base member and positioned within the cover. The distal end of each upwardly depending jewelry support rod has a hooked configuration and the cover is removable from the base for display of the jewelry upon the support rods. The cover is also rotatable upon the base member with an opening therein to provide easy access to all jewelry stored therein without removal of the cover. It is also contemplated for the base member and the cover to be configured and decorated as a object d'art or a lamp to conceal and safeguard the jewelry while the cover is positioned upon the base member. Applications may include, but are not limited to, both the displaying of elongated pieces of jewelry and its safeguarding from damage and loss.

9 Claims, 3 Drawing Sheets

HIDEAWAY JEWELRY TREE

BACKGROUND

1. Field of Invention

This invention relates to jewelry display racks and organizing storage containers, specifically to a storage container for elongated pieces of jewelry, such as necklaces and bracelets, having a base member, a removable cover rotatably supported upon the upper portion of the base member, a plurality of upwardly depending jewelry support rods attached to the base member and positioned within the cover, each jewelry support rod having a distal end configured as a hook, and an opening through the cover to provide access to the jewelry stored on the support rods within. The base member and the cover are also configured and decorated as a object d'art or a lamp to conceal and safeguard the jewelry while the cover is installed upon the base member. Applications may include, but are not limited to, both the displaying of elongated pieces of jewelry and its safeguarding from damage and loss.

2. Description of Prior Art

Jewelry organizers and display racks are known and used. They are important for storing jewelry so as to protect it from damage and loss, but to also make it readily available for use. A jewelry and accessory organizer for necklaces and bracelets, as well as earrings and belts, is disclosed in U.S. Pat. No. 5,242,048 to Ellingsworth (1993). The Ellingsworth invention comprises two vertically disposed side rails, a plurality of cross rails attached thereto, and a tray cross rail for holding loose items. In addition the Ellingsworth invention can include bottom posts upon which belt buckles may be secured. Another jewelry display rack is disclosed in U.S. Pat. No. 4,121,720 to Hayes (1978). The Hayes invention can be suspended from a supporting surface or a support stand, and comprises a plurality of vertically spaced horizontally disposed display rings with at least one of the rings having outwardly protruding fingers for supporting additional jewelry. It is contemplated for successively lower rings to increase in diameter and create a structure having a pyramidal configuration. The rings are each connected to adjacent rings by connecting members, the upper ends of which are supported by an upper support member. It is also contemplated for the bottommost ring to be connected to one end of a center post, the other end of the central post being connected to the upper support member. The Ellingsworth and Hayes inventions differ in configuration from the present invention which has a plurality of support rods upwardly depending from a base member. Also, the present invention has a cover for concealing the jewelry held by the support rods to protect it from damage and loss.

The prior art thought to be most closely related to the present invention is the invention disclosed in U.S. Pat. No. 4,390,099 to Trautlein (1983). The Trautlein invention discloses a pilfer resistant jewelry display stand for chains, necklaces and bracelets. The Trautlein invention comprises a circular ring supported upon a rod which upwardly depends from a base member. Gaps in the ring allow looped jewelry to be slipped over the ring. Locking sleeves then close the gaps in the ring to prevent easy separation of the jewelry from the ring to make the Trautlein display rack pilfer resistant. In contrast, the present invention has a different configuration, one that comprises a plurality of support rods upwardly depending from a base member configured and decorated to resemble an object d'art or the base of a lamp. Also, the present invention has a cover for concealing the jewelry held by the support rods to protect it from damage and loss. It is not known in this field to have a storage container for elongated pieces of jewelry, such as necklaces and bracelets, having a base member, a removable cover rotatably supported upon the upper portion of the base member, a plurality of upwardly depending jewelry support rods attached to the base and positioned within the cover, each rod having a distal end configured as a hook, and an opening through the cover to provide access to the jewelry stored on the support rods within, with the base member and the cover being configured and decorated as a object d'art or a lamp to conceal and safeguard the jewelry when the cover is installed upon the base member.

SUMMARY OF INVENTION—OBJECTS AND ADVANTAGES

It is the primary object of this invention to provide a jewelry organizer to keep necklaces and bracelets from tangling and becoming knotted. It is also an object of this invention to provide a jewelry organizer that is convenient and easy to use. A further object of this invention is to provide a jewelry organizer that has a theft-deterrent cover to conceal jewelry. It is also an object of this invention to provide a jewelry organizer which has an appearance which is eye-catching and attractive. A further object of this invention is to provide a jewelry organizer that stores jewelry in one easily accessible and space saving location. It is also an object of this invention to provide a jewelry organizer which has an appearance which is eye-catching and attractive. A further object of this invention is to provide a jewelry organizer that has an opening in its cover for easy accessibility to the jewelry stored within without having to remove the cover. It is also an object of this invention to provide a jewelry organizer which has a cover which is rotatable.

As described herein, properly manufactured and used, the present invention would provide a means for storing elongated pieces of jewelry, such as necklaces and bracelets, in the concealed and protected environment of a rotatable cover connected to a base member. Since the pieces of jewelry are each suspended from a hook on the upper end of an upright rod attached on one of its ends to the base member, each piece of jewelry is stored so as to be free from tangling and from becoming knotted. Also, since the cover rotates and has an opening therethrough, the cover allows convenient access to all of the jewelry contained therein without removal of the cover. The cover and supporting base can be configured as a lamp or an object d'art so as to disguise its function and safeguard its contents from theft. Since the present invention stores the pieces of jewelry in an upright manner, it also provides the user with a means of space-saving storage for the jewelry.

The description herein provides preferred embodiments of the present invention but should not be construed as limiting the scope of the hideaway jewelry tree invention. For example, variations in height and configuration of the base member, the length of the support rods, the shape of the hook depending from the distal ends of the jewelry support rods, the number of jewelry support rods used, the material from which the cover is made, and the configuration of the opening through which jewelry on the support rods may be accessed, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
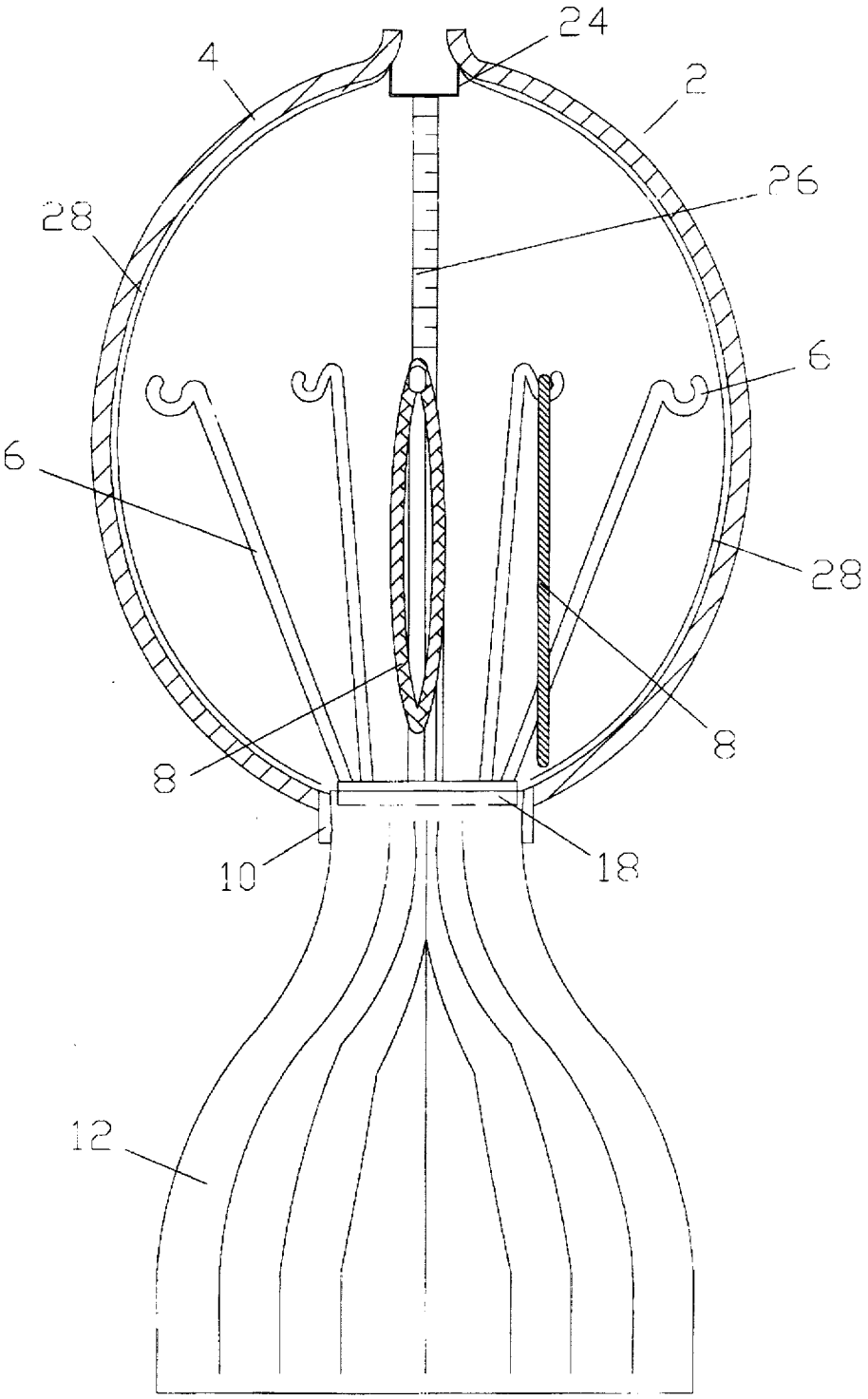
FIG. 1 is a sectional view of the invention showing hooked support rods supporting elongated pieces of jewelry.

FIG. 1 shows a preferred embodiment of a jewelry storing and display invention 2 having a base 12 and a cover 4 positioned above base 12. Although base 12 is shown configured as the base of a lamp, the configuration of base 12 is not critical to jewelry storing and display invention 2. However, the bottom of base 12 must be configured for placement upon a flat surface (not shown). FIG. 1 also shows a plurality of rods 6 positioned to upwardly depend from base 12, each rod 6 having a distal end configured as a hook, with several elongated pieces of jewelry 8 depending from the distal ends of rods 6. The distal end of each rod 6 is positioned with its hook adjacent to the inner surface of cover 4 for easy placement of pieces of jewelry 8 upon said distal ends. Between base 12 and cover 4, FIG. 1 shows a rotating bearing point 10 and an inner bearing 18 which allow cover 4 to rotate relative to base 12. FIG. 1 also shows cover 4 being supported by an inner wire 28 and a top support bracket 24 attached to the top of a centrally positioned tubular support member 26 which upwardly depends from base 12. In the preferred embodiment it is contemplated to have more than one inner wire 28. More than one top support bracket is also contemplated. The materials from which base 12 and cover 4 are made are not critical to jewelry storing and display invention 2, however base 12 must offer rigid support for cover 4 and rods 6, and in the preferred embodiment it is contemplated for cover 4 to be made from a woven fabric to resemble a lampshade.

Figure 2:
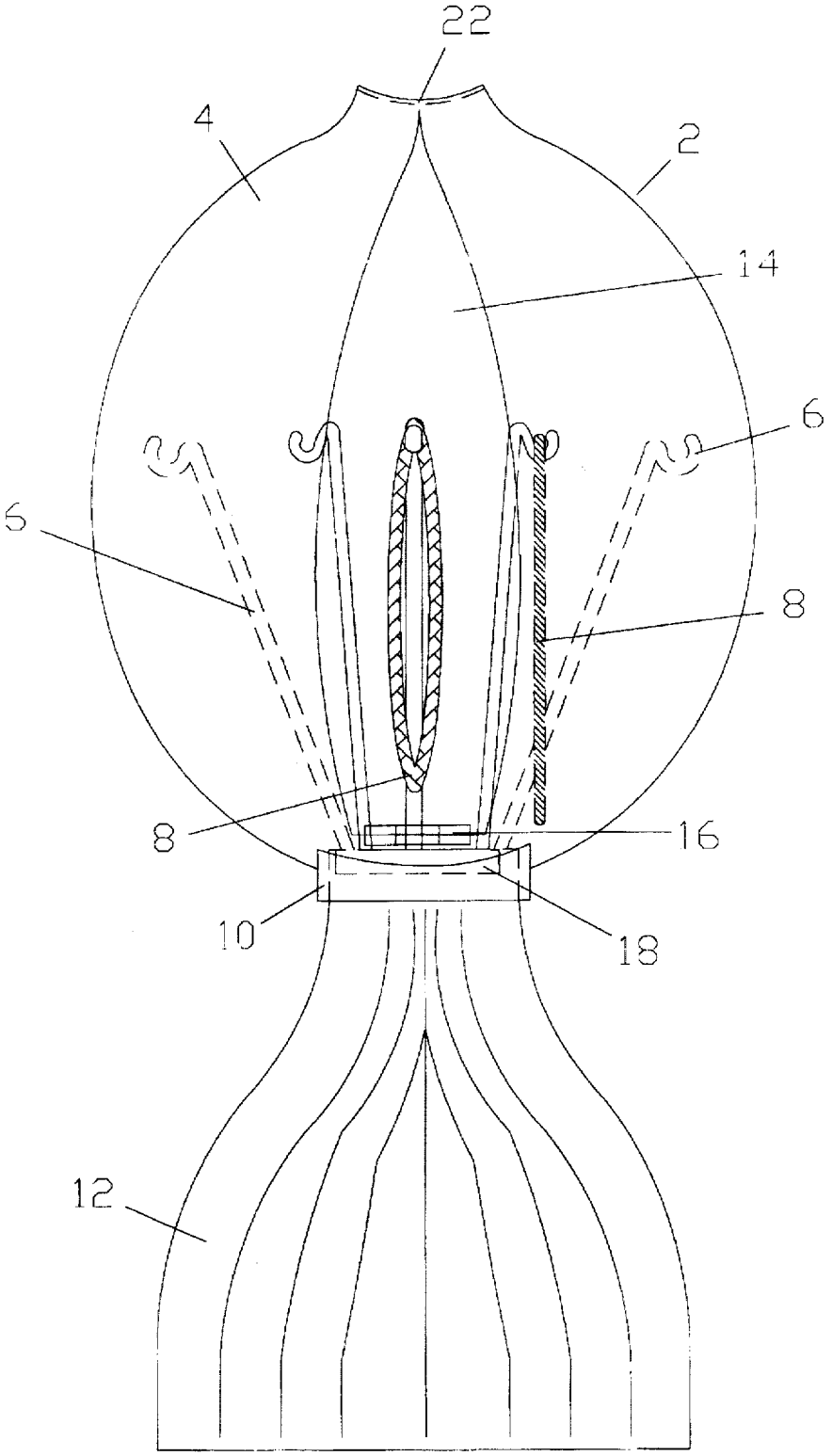
FIG. 2 is a front view of the invention with jewelry and support rods therein.

FIG. 2 shows cover 4 supported above base 12, with pieces of jewelry 8 suspended from the distal ends of rods 6. FIG. 2 also shows rotating bearing point 10 and inner bearing 18 positioned between base 12 and cover 4. In addition, FIG. 2 shows cover 14 having a vertically oriented opening 14 therethrough by which a user (not shown) can access pieces of jewelry 8 without having to remove cover 4. Also, FIG. 2 shows cover 4 having an inner support 22 adjacent to its uppermost edge and a hinging means 16 near the bottom portions of rods 6 for closing opening 14 to completely conceal pieces of jewelry 8 from outside view. In the alternative, although not shown, opening 14 can be quickly snapped shut by moving inner wires 28, which are positioned within the material forming the perimeter of opening 14, toward one another to cause the material adjacent to the perimeter to close opening 14.

Figure 3:
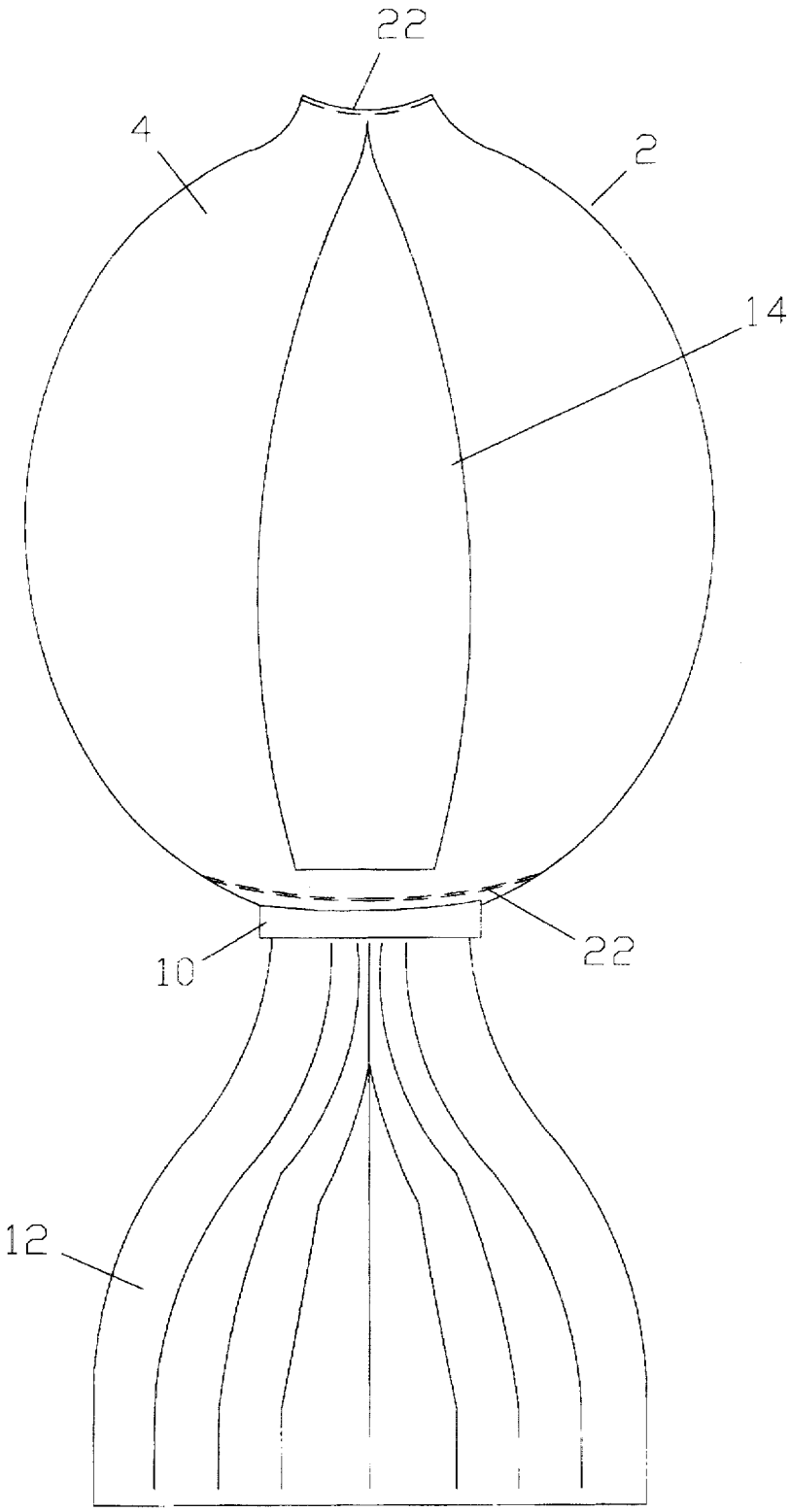
FIG. 3 is a front view of the invention without jewelry and support rods.

FIG. 3 also shows jewelry storing and display invention 2 having base 12, cover 4 positioned above said base 12, and rotating beating point 10 positioned between cover 4 and base 12. FIG. 3 further shows opening 14 in cover 4 having a vertically elongated configuration and one inner support 22 positioned near the top edge of cover 4, with another inner support 22 positioned near the bottom edge of cover 4. Although not critical to the present invention, in the preferred embodiment it is contemplated for jewelry storing and display invention 2 to have a height dimension ranging between eighteen inches and twenty-four inches, for rods 6 to be made from brass, for base 12 to be made from brass or wood, such as pine, oak, or cherry, and for cover 4 to be made from a fabric or injection molded plastic, such as polystyrene.

To use jewelry storing and display invention 2, pieces of jewelry 8 are placed through opening 14 and looped over the distal ends of rods 6 for tangle-free and knot-free support until removed therefrom. Cover 4 may be rotated so that opening 14 is adjacent to different rods 6 allowing pieces of jewelry 8 placed upon all rods 6 to be accessed without removing cover 4 from base 12. When pieces of jewelry 8 are positioned on rods 6, opening 14 can be closed with hinging means 16 to conceal pieces of jewelry 8 from theft, or in the alternative, opening 14 may be snapped shut by moving toward one another those inner wires 28 within the material of cover 4 forming the perimeter of opening 14. Also, cover 4 is completely separable from base 12 for display of pieces of jewelry 8.

What is claimed is:

1. A jewelry organizer for suspended storage and display of elongated pieces of jewelry to prevent tangling and knotting of said elongated pieces of jewelry, said organizer comprising a base member having a bottom configured for placement of said base member upon a flat surface; a cover positioned above said base member and rotatably connected to said base member; a plurality of rigid rods upwardly depending from said base member, each of said rods having a distal end configured as a hook for suspended support of said elongated pieces of jewelry; rotatable connecting means connected between said cover and said base member; and said cover having a closable opening therethrough for ease of access to said elongated pieces of jewelry stored on said distal ends of said rods without removal of said cover from said base member.

2. The organizer of claim 1 wherein said cover is made from flexible material, has top and bottom edges, and has an inner surface; and wherein said organizer further comprises a plurality of inner supports, at least one of said inner supports being attached said top edge and at least one of said inner supports being attached to said bottom edge; a plurality of inner wires positioned adjacent to said inner surface of said flexible material for vertical shaping thereof, a centrally positioned vertical tubular support having an upper end and a lower end, said lower end being attached to said base member; and a support bracket attached to said upper end for connection of said vertical tubular support to at least one of said inner supports positioned within said top edge of said cover.

3. The organizer of claim 2 wherein said opening in said cover has a perimeter, at least two of said inner wires are positioned within said flexible material adjacent to said perimeter, and wherein said flexible material can be used to close said opening by movement of those of said inner wires adjacent to said perimeter toward one another.

4. The organizer of claim 3 further comprising hinging means for closing said opening in said cover, said hinging means being attached to said flexible material adjacent to said opening.

5. The organizer of claim 1 further comprising hinging means for closing said opening in said cover, said hinging means being attached to said flexible material adjacent to said opening.

6. The organizer of claim 1 wherein said rotatable connecting means comprises at least one rotating bearing point and at least one inner bearing.

7. The organizer of claim 1 wherein said cover and said base have decorative configurations and markings thereon for further use in concealment of said elongated pieces of jewelry stored on said rods and protection thereof from theft.

8. A jewelry organizer for suspended storage and display of elongated pieces of jewelry to prevent tangling and knotting of said elongated pieces of jewelry, said organizer comprising a base member having a bottom configured for placement of said base member upon a flat surface; a cover positioned above said base member and rotatably connected to said base member; a plurality of rigid rods upwardly depending from said base member, each of said rods having a distal end configured as a hook for suspended support of said elongated pieces of jewelry; rotatable connecting means connected between said cover and said base member; said cover also having a closable opening therethrough for access to said elongated pieces of jewelry stored on said distal ends of said rods without having to remove said cover from said base member; said cover further being made from flexible material, having top and bottom edges, and an inner surface; a plurality of inner supports, at least one of said inner supports being attached to said top edge and at least one of said inner supports being attached to said bottom edge; a plurality of inner wires positioned adjacent to said inner surface of said flexible material for vertical shaping thereof, a vertically positioned tubular support having an upper end and a lower end, said lower end centrally connected to said base member and upwardly depending therefrom; a support bracket attached to said upper end for connection of said vertical tubular support to those of said inner supports which are positioned within said top edge of said cover; said opening in said cover having a perimeter with at least two of said inner wires being positioned within said flexible material adjacent to said perimeter so that said flexible material can be used to close said opening by movement of those of said inner wires adjacent to said perimeter toward one another; hinging means for closing said opening in said cover, said hinging means attached to said flexible material adjacent to said opening; and wherein said cover and said base have decorative configurations and markings thereon for further concealment of said pieces of jewelry stored on said rods and protection thereof from theft.

9. The organizer of claim 1 wherein said rotatable connecting means comprises at least one rotating bearing point and at least one inner bearing.

* * * * *